US005730203A

United States Patent [19]

Mogensen

[11] Patent Number: 5,730,203

[45] Date of Patent: Mar. 24, 1998

[54] METHODS OF CLOSING THE INLET IN A MOULD AFTER NON-GRAVITY CASTING WITH A NON-FERROUS ALLOY OF GREEN-SAND MOULDS IN A MOULD-STRING PLANT

[75] Inventor: Vagn Mogensen, Gentofte, Denmark

[73] Assignee: Georg Fischer Disa A/S, Herlev, Denmark

[21] Appl. No.: 737,672

[22] PCT Filed: May 23, 1995

[86] PCT No.: PCT/DK95/00204

§ 371 Date: Nov. 21, 1996

§ 102(e) Date: Nov. 21, 1996

[87] PCT Pub. No.: WO95/32826

PCT Pub. Date: Dec. 7, 1995

[30] Foreign Application Priority Data

May 27, 1994 [DK] Denmark ..... 0601/94

[51] Int. Cl.[6] ..... B22D 18/04; B22D 37/00

[52] U.S. Cl. ..... 164/119; 164/134; 164/136; 164/147.1; 164/306; 164/337

[58] Field of Search ..... 164/133, 136, 164/130, 147.1, 500, 323, 337, 119, 134, 306

[56] References Cited

U.S. PATENT DOCUMENTS 3,903,956 9/1975 Pekrol .

4,589,466 5/1986 Chandley et al. .

4,961,455 10/1990 Redemske et al. ..... 164/337 X 5,111,871 5/1992 Cook ..... 164/63

FOREIGN PATENT DOCUMENTS 1171199 8/1985 U.S.S.R. ..... 164/136

WO 93/11892 6/1993 WIPO .

*Primary Examiner*—J. Reed Batten, Jr.

*Attorney, Agent, or Firm*—Larson & Taylor

[57] ABSTRACT

A cylindrical element (14) with a through-going passage (15) is retained in the mold in such a manner that a part of the element (14) protrudes from the outside of the mold, and so that the passage (15) opens into a part of the runner (8) of the mold, the internal terminal surface of element (14) lying opposite a plane surface (16) in the runner (8). During casting, the nozzle (13) of a casting device is brought into tight-fitting abutment against the outer end of the element, and the molten metal alloy is cast into the mold through the nozzle (13), the passage (15) in the element (14) and the runner (8) of the mold. After casting of the mold, the nozzle (13) is pressed against the element (14) with a considerably greater force than its abutting force during casting, thus causing the element to be displaced axially into the mold to form a fight-fitting abutment against the surface (16) in the runner (8) and blocking the latter, enabling the nozzle (13) to be withdrawn without cast metal flowing out from the mold.

15 Claims, 7 Drawing Sheets

METHODS OF CLOSING THE INLET IN A MOULD AFTER NON-GRAVITY CASTING WITH A NON-FERROUS ALLOY OF GREEN-SAND MOULDS IN A MOULD-STRING PLANT

TECHNICAL FIELD

The invention relates to methods for closing the inlet in a mould after non-gravity casting with a non-ferrous alloy of green-sand moulds in a mould-string plant.

BACKGROUND ART

The international patent application WO 93/11892 relates to a method and a casting device for non-gravity casting with a light-metal alloy of green-sand moulds in a mould-string plant like the "Disamatic" moulding plant manufactured and marketed by Baxi Partnership Ltd. of Preston GB. In this known method, depicted in FIGS. 1*a–b*, the light-metal alloy is pumped by means of an electromagnetic pump from a heated reservoir through a heated ceramic tube into a bottom inlet disposed in the parting surface between the moulds, thus filling the mould. To prevent the metal from flowing out from the mould, the inlet must be closed before the nozzle of the casting device is removed from the inlet, and this specification indicates three different ways of achieving this, viz.:

1) A core provided with a through-going opening is disposed movably parallel to the outer surface of the mould in a guideway in the mould opposite the mould inlet so that the opening in the core during casting of the mould can be brought to lie aligned with said inlet, while the core after full-casting of the mould is displaced so that a compact part of the core is aligned with the inlet and closes it. The specification shows and describes both a horizontally and a vertically displaceable core.

A drawback of this closing method is that during the displacement of the core, the nozzle of the casting device must abut sealingly against the latter with a certain force, thus at least hampering the displacement of the core.

2) After full-casting of the mould, the inlet of the latter is closed by pressing a metal plate obliquely from above down through the mould material encompassing the inlet of the mould, thus closing the inlet. As the pumping direction of the electromagnetic pump is reversed immediately before withdrawing the nozzle of the casting device from its sealing abutment around the inlet opening in the mould, there is a risk that the metal being pumped back carries along with it moulding sand having been torn loose during the pressing-down of the metal plate. During casting of the next mould, this moulding sand will then be pumped into this mould and may cause defects in the casting.

In both above-mentioned methods of closing the inlet of the mould, the nozzle of the casting device is withdrawn from the mould after casting the latter during the stepwise advancement of the mould string, then to be moved forward in abutment against the inlet of the succeeding mould in the mould string for casting said succeeding mould.

3) In this closing method, the nozzle of the casting device is pressed constantly against the side of the mould string, and a cutting edge is disposed at the mould string upstream of the nozzle, said cutting edge "planing" a groove in the side of the mould string, in which groove the nozzle and a chill plate mounted downstream of it are displaced during the stepwise movement of the mould string. During the casting of a mould, the chill plate covers the inlet of the previously filled mould and cools the metal within the inlet to solidification, thus causing the inlet to be closed. This closing method requires rather complicated equipment with means for controlling the force with which the nozzle is pressed against the side of the mould string, as well as the cooling of the chill plate.

SUMMARY OF THE INVENTION

The object of the invention is to provide improved methods of closing the inlet in moulds of the kind described by casting the moulds by means of the known method and with the known casting device and including the object of especially avoiding the drawbacks mentioned under 1) and 2), and to suggest further alternative methods hereof.

A first method of closing the inlet in accordance with the present invention is by using a movable element.

The movable element may be composed of any material capable of resisting the temperature influence and the erosion from the cast metal, e.g. of cured core sand, ceramic material or metal.

By placing the element in a recess of suitable dimensions disposed in at least one of the mould parting surfaces, it is gripped between the mould parts in such a manner that the frictional force to be overcome in order to displace the element inwardly into the mould is greater than the requisite force to press the nozzle of the casting device against the element to create a seal during casting of the mould. A further resistance to displacement of the element can e.g. be achieved, if the element is provided with at least one groove about at least a part of its circumference, said groove co-operating with a complementary projection located in at least one mould part, as in that case, the shear strength of this projection has to be overcome before the element can be moved inwardly into the mould. Also other measures obvious to a skilled person for increasing the resistance of the element to displacement inwardly into the mould may be possible.

Alternative advantageous embodiments of the methods according to the invention, are explained in the following detailed portion.

BRIEF DESCRIPTION OF THE DRAWINGS

The present invention will be described in more detail in the following detailed portion of the specification with reference to the drawings, in which FIG. 1*b* diagrammatically illustrates the previously mentioned known method of bottom filling with a light-metal alloy of green-sand moulds, while FIG. 1*a* diagrammatically illustrates a mould-string plant.

DESCRIPTION OF THE PREFERRED EMBODIMENTS

Figure 1A:
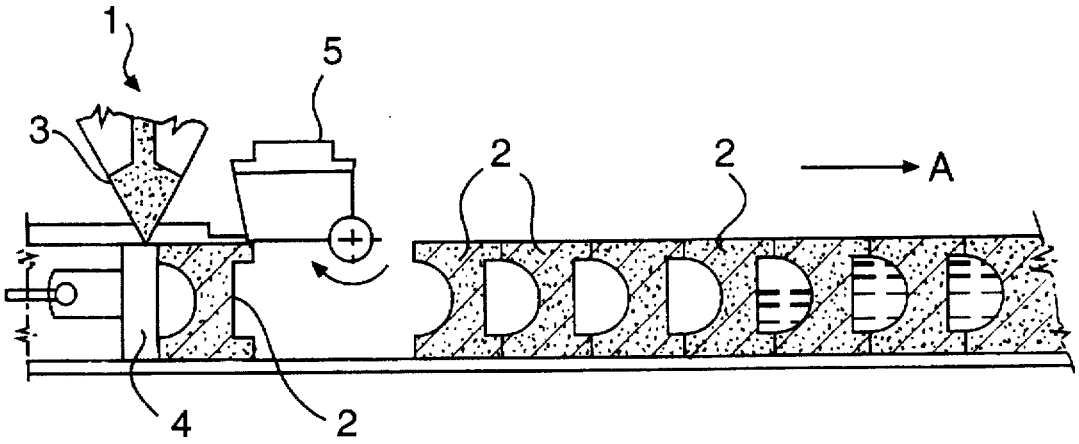
FIG. 1a PRIOR ART
Figure 1B:
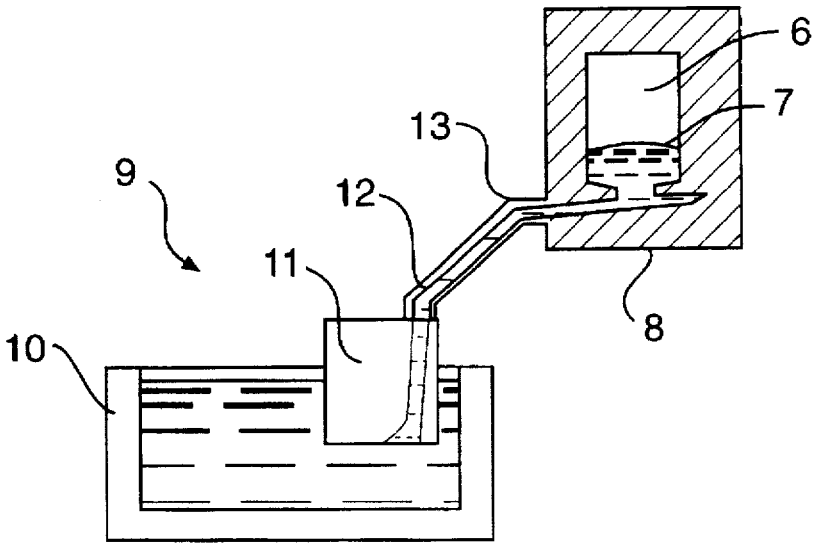
FIG. 1b PRIOR ART

FIG. 1 diagrammatically illustrates the method of casting green-sand moulds in a mould-string plant known from the international patent application WO 93/11892. This comprises a moulding machine—generally designated 1—similar to the "Disamatic"-moulding machine manufactured and marketed by the Baxi Partnership Ltd. of Preston GB and dealt with in U.S. patent specification No. 3,008,199, whose mode of operation is described in the previously mentioned international patent application and for this reason only dealt with broadly in this specification.

Box-less mould parts 2 made from loose green sand, i.e. sand with moist clay as binder, supplied from a hopper 3 to a moulding chamber defined between a pattern located on a movable piston 4 and a pattern located on a movable and upwardly pivotable counter-pressure plate 5 in a downwardly pivoted position (not shown) of the counter-pressure plate 5. In the moulding chamber, the green sand is compacted by the piston 4 to form a mould part 2, the counter-pressure plate 5 is conveyed forward and pivoted upwards to the position shown in FIG. 1, after which the mould part 2 is conveyed by the piston 4 to abut against the mould string formed by previously produced mould parts 2, said mould string being conveyed a distance corresponding to the thickness of a mould part in the direction indicated by the arrow A. In the mould string, the front side of a mould part 2 together with the rear side of the previous mould part 2 defines a mould cavity 6 being cast with a light-metal alloy 7 through a bottom inlet, in general designated 8, and situated in or at the parting surface between two mould parts 2, by means of a casting device in general designated 9.

The casting device 9 consists of a heated reservoir 10 for the molten metal, in which an electromagnetic pump 11 is submerged, via a heated ceramic tube 12 pumping the molten metal up to a nozzle 13 which is in tight-fitting abutment around the casting opening to the inlet or the runner 8.

It will be appreciated that the casting of the mould cavity 6 must take place while the mould string is stationary, i.e. within the intervals between each time the piston 4 advances the mould string through a distance corresponding to the thickness of a mould part 2 in the direction of the arrow A.

After casting of the mould cavity 6 the inlet 8 must be closed, after which the nozzle 13 can be retracted, possibly while reversing the pump 11, so that after the next movement of the mould string in the direction of the arrow A, the nozzle is ready to be brought into tight-fitting abutment around the casting opening to the runner 8 against the next mould cavity 6 in the mould string.

What has been described up to this point solely relates to the art known from the previously mentioned international patent application, and the runner is shown here as opening into the bottom of the mould cavity 6. It will be understood, however, that with non-gravity casting, the runner may also open into the mould cavity at some other location along its height. The non-ferrous alloy used is not necessarily a light-metal alloy.

Figure 2A:
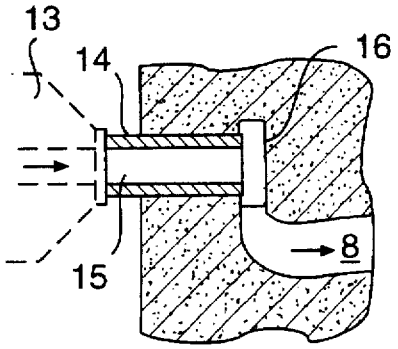
FIGS. 2*a–2d* illustrate a first method according to the invention of closing the inlet by means of a movable element before (2*a* and *c*) and after (2*b* and *d*), respectively, closing of the inlet shown in vertical section through the mould parting surface, FIGS. 3*a*, *b* and *c* show vertical cross-sections through three modifications of the movable element shown in FIG. 2, FIGS. 4*a–4d* in the same way as in FIG. 2 illustrate a second embodiment of the method represented in FIG. 2 before (4*a* and *c*) and after (4*b* and *d*), respectively, the closing of the inlet, FIGS. 5*a* and *b* in the same way as in FIGS. 2 and 4 illustrate a further method according to the invention of closing the inlet by means of a plate before and after, respectively, closing of the inlet, FIGS. 6*a* and *b* in the same way as in FIGS. 2, 4 and 5 illustrate yet another embodiment of the method represented in FIG. 5 before and after, respectively, closing of the inlet, FIGS. 7*a* and *b* in the same way as in FIGS. 2 and 4–6 illustrate a third method according to the invention of closing the inlet before and after, respectively, closing the same, and FIGS. 8*a* to 8*e* in the same way as in FIGS. 2 and 4–7 illustrate a fourth method according to the invention of closing the inlet, a metal tube being used during casting of the mould and subsequently being blocked in three different ways.

FIGS. 2*a* and *b* illustrate a first embodiment of a first method according to the invention of closing the inlet 8 by means of a displaceable element 14. The element 14, which may e.g. be made from cured core sand or ceramic material or from metal, is cylindrical and has a through-going circular-cylindrical passage 15 and is preferably disposed symmetrically around the parting surface between two mould parts 2—it may, however, border on this parting surface in such a manner that it is fixedly held by friction with the moulding sand, and in such a manner that it projects somewhat from the (lateral) surface of the mould string. On its surface encompassed by the moulding sand or on a part of this surface, the element 14 may possibly comprise at least one groove co-operating with projections formed in either or both of the mould parts 2. As shown in FIG. 2*a*, during casting of the mould in the direction of the arrows shown, the outer, plane end of the element 14 is in tight-fitting abutment against the nozzle 13 of the casting device 9, the element 14 being retained in the moulding sand with a force capable of resisting the sealing pressure in this step being exerted on the element 14 by the nozzle 13.

Figure 2B:
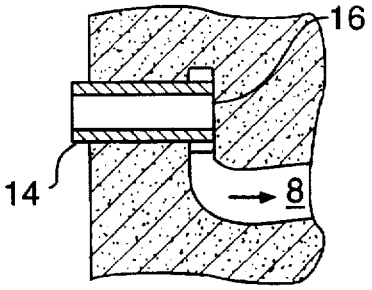

When the mould has been filled completely, a considerably greater pressure is exerted on the element 14 by means of the nozzle 13, causing the element to be displaced inwardly into the mould to the position shown in FIG. 2*b*, in which the plane inner end of the element 14 is brought into tight-fitting abutment against a plane surface 16 in the inlet 8, said plane surface 16 being parallel to the inner end surface of the element 14. This causes closing of the inlet 8, and the nozzle 13 may be withdrawn as mentioned previously.

Figure 2C:
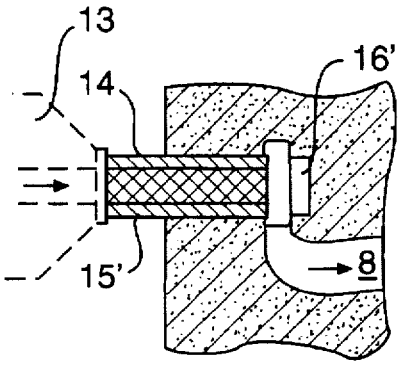
Figure 2D:
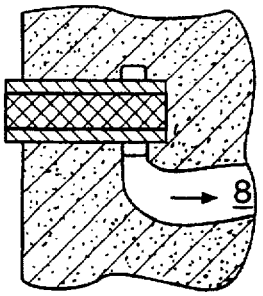

FIGS. 2*c* and *d* illustrate a modification of the embodiment shown in FIGS. 2*a* and *c*, in which the plane surface 16 in the inlet 8 is replaced by a recess or a seat 16' for the plane inner end of the element 14, providing a more reliable seal. Moreover, the internal cavity or the passage 15 in the element 14 is filled with a sieve-like material 15' capable of retaining possible solid matter and/or slag in the metal being cast, resulting in a final casting without such impurities. The sieve-like material must, of course, be able to resist influences from the metal being cast.

Figure 3A:
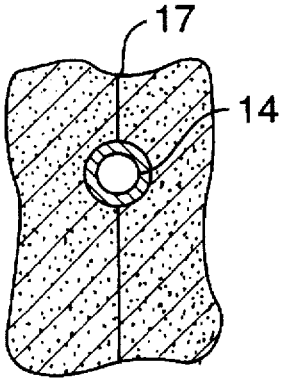
Figure 3B:
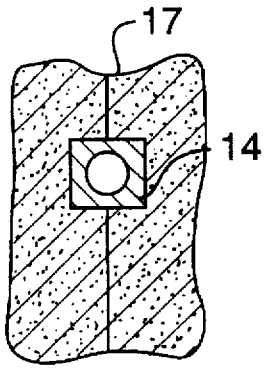
Figure 3C:
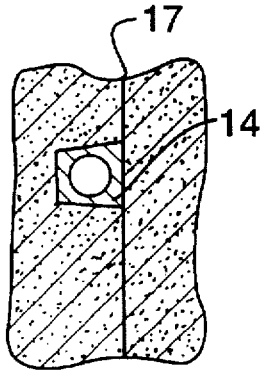

FIGS. 3*a*, *b* and *c* show three embodiments of the cross-section of the element 14 in FIGS. 2*a* and *b*. In FIG. 3*a* the element has a circular-cylindrical outer surface and is placed symmetrically around the mould parting surface 17. In FIG. 3*b* the outer surface of the element has a square cross-section, and the element 14 is placed symmetrically around the mould parting surface 17 with two of its outer surfaces parallel to it. In FIG. 3*c* the outer surface of the element 14 has a trapezoidal cross-section, and the entire element 14 is situated in one mould part in such a manner that the longer parallel side of the trapezoidal cross-section lies in the parting surface 17.

Figure 4A:
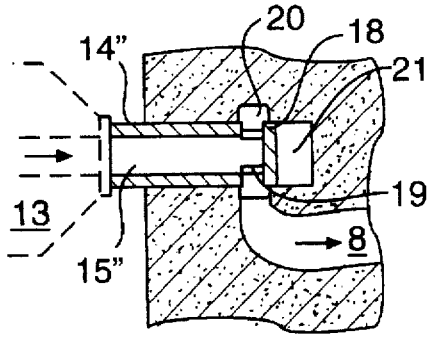

FIGS. 4*a* and *b* represent another embodiment of the method illustrated in FIG. 2. In FIG. 4*a*, the element 14" is retained as explained above with respect to the element 14 in FIG. 2*a* and has a circular-cylindrical outer suface and an internal circular-cylindrical passage 15" which, however, is closed at the internal end by a wall 18. In the circumferential wall of the element 14" and immediately adjacent to the end wall 18 there are two openings 19 situated diametrically opposite each other, said openings as shown in FIG. 4*a* opening into an annular part 20 of the inlet 8, said annular part 20 encompassing the innermost part of the element 14". Within the end wall 18 the mould has a circular-cylindrical cavity 21 of substantially the same diameter as that of the element 14" and with an axial extent somewhat greater than the thickness of the end wall 18 plus the axial extention of the openings 19.

Figure 4B:
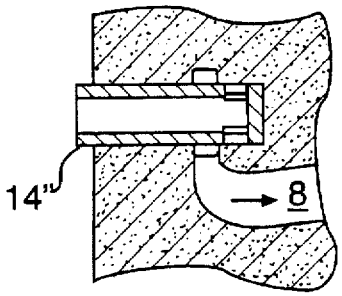

After the mould has been filled by means of the nozzle 13 of the casting device as shown in FIG. 4*a* in the direction indicated by arrows through the passage 15", the openings 19, the annular part 20 and the inlet 8, during which the end wall 18 of the element 14" exhibits a considerably higher resistance against erosion than the plane moulding-sand surface 16 or the seat 16' in the embodiment of FIG. 2, the element 14" is by means oft he nozzle 13 pressed into the mould to the position shown in FIG. 4*b*, in which the openings 19 are situated entirely within the cavity 21, and the annular part 20 of the inlet 8 is closed by the outer surface of the element 14". The nozzle 13 can then be withdrawn as explained previously.

Figure 4C:
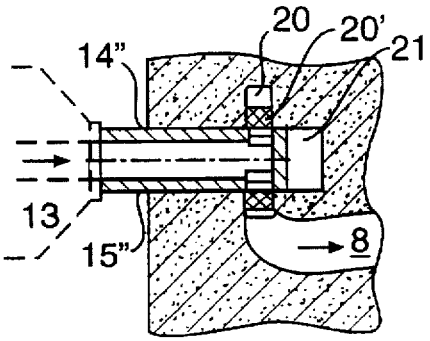
Figure 4D:
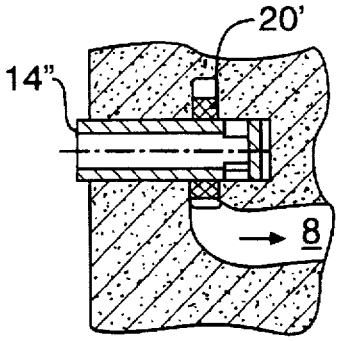

In a modification of this embodiment shown in FIGS. 4*c* and *d*, a sieve-like material 20' is placed in the annular part 20 of the inlet 8 encompassing the element 14" and the openings 19 in the latter, said sieve-like material being capable of retaining solid matter and/or slag in the cast metal in a similar manner as the sieve-like material in the modification of the first embodiment shown in FIGS. 2*c* and *d*.

Figure 5A:
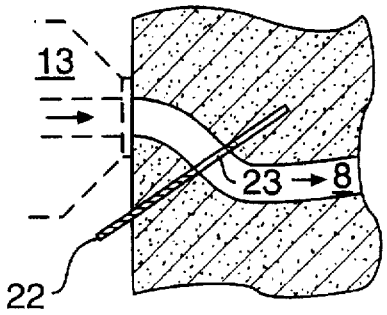
Figure 5B:
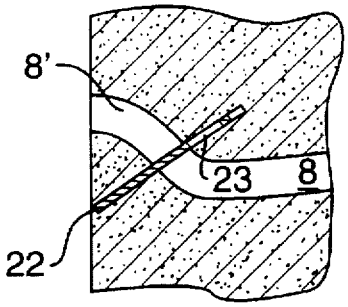

FIGS. 5*a* and *b* illustrate a first embodiment of a second method according to the invention, in which the closing of the inlet takes place by means of a plate, which might be a metal plate as known from the state of the art referred to initially, but which might also consist of some other suitable material, e.g. a ceramic material. At this location adjacent the casting inlet, the inlet or the runner 8 has a downwardly inclined part 8', across and substantially at right angles to which a plate 22 is located in oppositely disposed grooves in the mould parts 2. The plate 22 has a through-going opening 23, which in the casting position of FIG. 5*a* is aligned with the downwardly extending part 8' of the runner 8, as the plate 22 in this position protrudes somewhat from the outside of the mould. After filling of the mould via the nozzle 13 with metal in the direction indicated by arrows, the plate 22 is moved into the mould to the position shown in FIG. 5*b*, so that it bars or closes the inclined part 8' of the runner 8, enabling the nozzle 13 to be withdrawn as mentioned above without the metal flowing out from the mould.

Figure 6A:
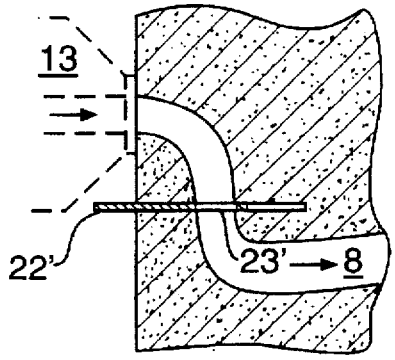
Figure 6B:
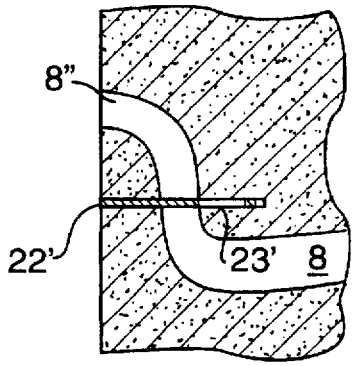

In the embodiment of this method illustrated in FIGS. 6*a* and *b*, the part 8" of the runner adjacent the casting inlet extends substantially vertically over at least a part of its length, and the plate 22' is placed in oppositely disposed grooves in the mould parts 2 and extends at right angles to the vertical part of the duct 8", i.e. substantially horizontally. The plate 22' has a through-going opening 23', which in the casting position shown in FIG. 6*a* is aligned with the duct 8", and in this position the plate 22' protrudes somewhat from the outside of the mould below the nozzle 13. After filling of the mould, the plate 22' is pushed into the latter to the position shown in FIG. 6*b*, in which it bars the runner part 8" and hence causes a closure of the mould inlet so that the nozzle 13 can be withdrawn as explained above.

Figure 7A:
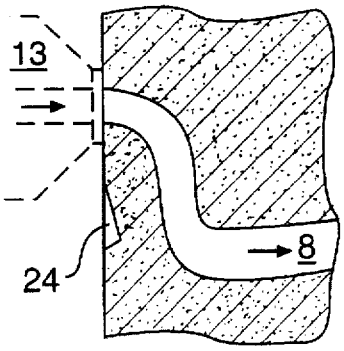
Figure 7B:
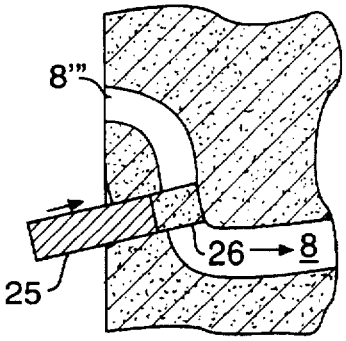

In the third method according to the invention illustrated in FIGS. 7*a* and *b*, the part 8" of the runner 8 adjacent the casting inlet extends obliquely, downwardly, and opposite said part 8" a recess 24 is provided in the outside of the mould, the bottom of said recess extending parallel to the obliquely downwardly extending runner 8'". After filling the mould by means of the nozzle as shown in FIG. 7*a*, a piston 25 is pressed against the bottom of the recess 24 in such a manner that the moulding sand adjacent the piston 25 between the bottom of the recess 24 and the duct 8'" is pressed into the latter in the shape of a plug 26 locking the duct 8'" and consequently closing the inlet to the mould. The nozzle 13 may then be withdrawn optially after reversing the pump 11, since—due to the downwardly inclined extension of the duct 8'"—there is only a small risk of mould-sand particles from the plug 26 being sucked into the pump.

Figure 8A:
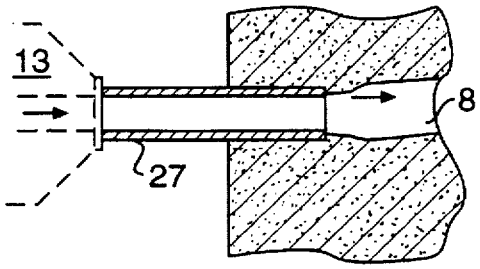
Figure 8B:
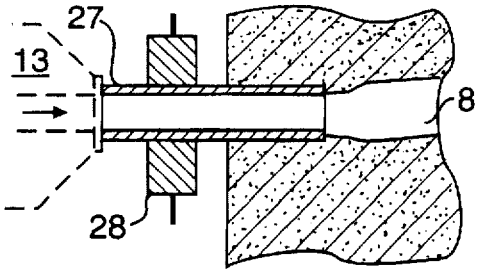
Figure 8C:
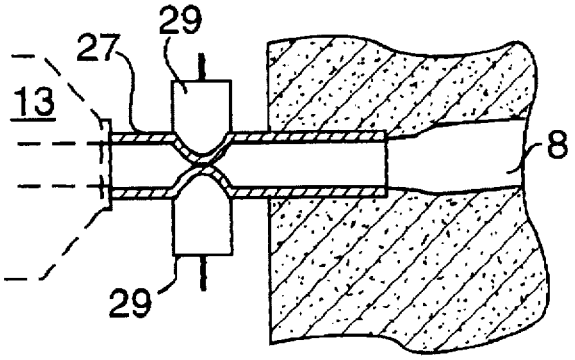
Figure 8D:
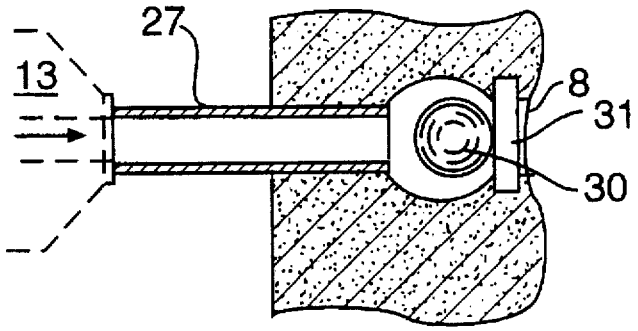
Figure 8E:
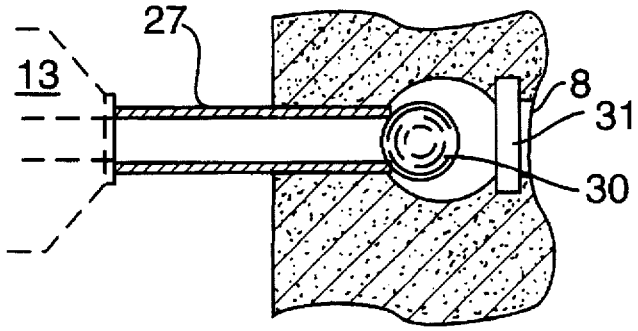

In the fourth embodiment of the method according to the invention of closing the inlet, as illustrated in FIGS. 8*a* to 8*e*, the outermost part of the runner 8 adapted to receive in abutment the nozzle 13 consists of a metal tube 27 secured in the mould. After filling the mould as shown in FIG. 8*a*, the metal tube 27 is barred, either by placing cooling elements 28 around the metal tube 27 as shown in FIG. 8*b*, said cooling elements cooling the tube 27 and the metal within it to make the latter solidify in the tube 27 as a plug closing the inlet of the mould, or by squeezing the metal tube 27 as shown in FIG. 8*c* between a pair of jaws 29 so as to close the inlet of the mould, or as shown in FIGS. 8*d* and *e* by having the metal tube 27 opening into an expanded portion of the inlet 8, which portion contains a check-valve ball 30 and is partially barred at its downstream end by means of a pin 31 embedded into the mould-sand. During casting the metal may as shown in FIG. 8*d* pass freely past the ball 30 resting against the pin 31, while—when casting is interrupted—the check-valve ball 30 closes the opening of the tube 27 as shown in FIG. 8*e*.

I claim:

1. A method of non-gravity casting in a mould-string plant comprising the steps of:

producing a string of moulds of mould sand with an alloy inlet system therein, including the steps of forming an inlet runner to a mould cavity, and securing a hollow element in the mould sand (a) with an outlet of the hollow element in the inlet runner to the mould cavity, (b) with a holding force and (c) with an entrance end of the hollow element forming an outermost part of the alloy inlet system;

abutting a nozzle of a casting device against the entrance end of the hollow element with sufficient force to seal against the entrance end but with less force than the holding force;

non-gravity casting of the mould cavity through the nozzle, entrance end, outlet, and inlet runner with a non-ferrous alloy; and exerting, after casting is complete, a force greater than the holding force on the entrance end of the hollow element to displace the hollow element axially into the mould a sufficient distance to close the outlet of the hollow element with the mould sand.

2. A method of non-gravity casting as claimed in claim 1:

wherein said forming step includes the step of providing a sealing surface in the inlet runner;

wherein said securing step secures the hollow element which is tubular and the outlet thereof is a plane end surface substantially at a right angle to an axis of the tubular hollow element, and said securing step includes the positioning of plane end surface of the tubular hollow element parallel and opposite to the sealing surface but spaced therefrom so as not to block passage of the alloy during casting; and wherein said exerting step includes the step of displacing the tubular hollow element axially into the mould so that the plane end surface is driven into the sealing surface.

3. A method of non-gravity casting as claimed in claim 2:

wherein said providing step provides the sealing surface as a seat displaced radially from an adjacent portion of the inlet runner.

4. A method of non-gravity casting as claimed in claim 2:

wherein the tubular hollow element has an outer surface which is circular-cylindrical;

wherein said producing step produces the string of moulds with the moulds separated at a mould parting plane; and wherein said securing step secures the tubular hollow element symmetrically at the mould parting plane.

5. A method of non-gravity casting as claimed in claim 2:

wherein the tubular hollow element has an outer surface which is rectangular in cross section;

wherein said producing step produces the string of moulds with the moulds separated at a mould parting plane; and wherein said securing step secures the rectangular hollow element symmetrically at the mould parting plane such that two outer sides of the hollow element are parallel to the mould parting surface.

6. A method of non-gravity casting as claimed in claim 2:

wherein the tubular hollow element has an outer surface which is trapezoidal in cross section;

wherein said producing step produces the string of moulds with the moulds separated at a mould parting plane; and wherein said securing step secures the trapezoidal hollow element in each mould with a longest parallel side lying in the mould parting plane.

7. A method of non-gravity casting as claimed in claim 1:

wherein said securing step further includes the step of providing a sieve material for retaining solid matter and slag in a passage of the hollow element located between the entrance end and the outlet.

8. A method of non-gravity casting as claimed in claim 1:

wherein the hollow element has an outer surface which is circular-cylindrical and the outlet is radially directed from adjacent a closed inner end of the hollow element; and wherein said forming step includes the step of providing a circular-cylindrical sealing cavity in the inlet runner into which the closed inner end and radially directed outlet are received when the hollow element is displaced to close the outlet.

9. A method of non-gravity casting as claimed in claim 8:

wherein said producing step further includes the step of locating a sieve material for retaining solid matter and slag present in the alloy in the inlet so as to surround the hollow element and cover the radially directed outlet.

10. A method of non-gravity casting in a mould-string plant comprising the steps of:

producing a string of moulds of mould sand with an alloy inlet system therein, including the step of forming an inlet runner to a mould cavity, the inlet runner including a downwardly extending part located between an inlet and the mould cavity;

abutting a nozzle of a casting device against the inlet of the inlet runner with sufficient force to seal against the inlet;

non-gravity casting of the mould cavity through the nozzle and inlet runner with a non-ferrous alloy; and pressing, after casting is complete, a plug of the mould sand from an outside of the mould disposed adjacent the downwardly extending part of the inlet runner into the downwardly extending part of the runner to close the inlet runner.

11. A method of non-gravity casting in a mould-string plant comprising the steps of:

producing a string of moulds of mould sand with an alloy inlet system therein, including the steps of forming an inlet runner to a mould cavity, the inlet runner including (a) relative to a flow direction in the inlet runner from an inlet to the mould cavity, a downwardly extending part located between the inlet and the mould cavity and (b) oppositely disposed grooves in adjacent moulds provided at right angles to the downwardly extending part and extending to adjacent surfaces of the adjacent moulds, and securing a plate in the oppositely disposed grooves with a through opening in the plate aligned with the inlet runner and an extension of the plate extending out beyond the adjacent surfaces of the adjacent moulds;

abutting a nozzle of a casting device against the inlet of the inlet runner with sufficient force to seal against the inlet;

non-gravity casting of the mould cavity through the nozzle and inlet runner with a non-ferrous alloy; and pressing, after casting is complete, the extension of the plate into the adjacent moulds from outside of the adjacent moulds to displace the through hole out of the downwardly extending part of the inlet runner and into the grooves disposed adjacent the downwardly extending part of the inlet runner to close the inlet runner.

12. A method of non-gravity casting as claimed in claim 11:

wherein said forming step forms the downwardly extending part of the inlet runner at an angle to vertical of 30° to 60°.

13. A method of non-gravity casting as claimed in claim 12:

wherein said forming step forms the downwardly extending part of the inlet runner at an angle to vertical of 45°.

14. A method of non-gravity casting as claimed in claim 11:

wherein said forming step forms the downwardly extending part of the inlet runner substantially vertically; and wherein said securing step secures the plate substantially horizontally and at a right angle to the adjacent mould surfaces of the adjacent moulds at a position which is below a lowermost part of the nozzle when the nozzle is engaged with the inlet runner during said casting step.

15. A method of non-gravity casting in a mould-string plant comprising the steps of:

producing a string of moulds of mould sand with an alloy inlet system therein, including the steps of forming an inlet runner to a mould cavity of a mould, the inlet runner including an upstream end, and securing a metal tube in the upstream end of the inlet runner with an extension of the metal tube extending out beyond the mould;

abutting a nozzle of a casting device against an inlet of the metal plate with sufficient force to seal against the inlet;

non-gravity casting of the mould cavity through the nozzle, metal tube and inlet runner with a non-ferrous alloy; and cooling, after casting is complete, a part of the extension of the metal tube by application of a cooling element to an outside of the extension part to solidify the alloy adjacent the cooling element and hence to close the inlet runner.

* * * * *